US007185770B1

(12) United States Patent
Roten

(10) Patent No.: US 7,185,770 B1
(45) Date of Patent: Mar. 6, 2007

(54) MODULAR STORAGE RACK

(76) Inventor: Randal E. Roten, 3304 Buck Run Trail, Wake Forest, NC (US) 27587

( * ) Notice: Subject to any disclaimer, the term of this patent is extended or adjusted under 35 U.S.C. 154(b) by 119 days.

(21) Appl. No.: 10/907,128

(22) Filed: Mar. 22, 2005

(51) Int. Cl.
*A47F 7/00* (2006.01)

(52) U.S. Cl. ..... 211/70.6; 211/87.01

(58) Field of Classification Search ..... 211/70.6, 211/183, 60.1, 87.01, 75, 63, 85.18, 16, 88.04; 248/214, 311.2, 314
See application file for complete search history.

(56) References Cited

U.S. PATENT DOCUMENTS 4,199,070 A * 4/1980 Magnussen, Jr. ..... 211/60.1
4,306,697 A * 12/1981 Mathews ..... 248/68.1
4,410,095 A * 10/1983 Dembicks ..... 211/70.6
5,855,285 A * 1/1999 Laird et al. ..... 211/70.6
5,884,782 A * 3/1999 Dembicks ..... 211/70.6
6,109,569 A * 8/2000 Sakaida ..... 248/75
6,422,401 B1 7/2002 Roten ..... 211/32
6,932,223 B1 * 8/2005 Lee et al. ..... 211/70.6

* cited by examiner

*Primary Examiner*—Jennifer E. Novosad
(74) *Attorney, Agent, or Firm*—Mills Law Firm PLLC

(57) ABSTRACT

A storage rack formed of modular sleeve units assembled to variable lengths at mating tab and slot connections for attachment to mounting surfaces horizontally or vertically for storing and organizing articles.

10 Claims, 7 Drawing Sheets

MODULAR STORAGE RACK

FIELD OF THE INVENTION

The present invention relates to storage devices and, in particular, to a storage system using modular components.

BACKGROUND OF THE INVENTION

At home and at work, storage devices are used for organizing and storing various articles. Wall or vertical surface racks, with ledges, hooks and containers have been used for organizing tools, utensil, parts and the like. An example of such a rack used for storing and fashioning baseball-type hats is disclosed in my U.S. Pat. No. 6,422,401. These rack provide a fixed holding capacity, which may be greater or less than required for a particular application, resulting in under capacity requiring additional units or over capacity resulting in excessive space requirements.

BRIEF SUMMARY OF THE INVENTION

The present invention provides a flexibly sized storage rack for vertical surface mounting formed of modular interconnecting components allowing users to effectively size a storage system for their designated need. The rack comprises a basic support sleeve having a projecting tab and a recessed slot at opposite ends thereof that are telescopically assembled with complementary tabs and slots on adjacent components to create a rack of desired length and storage capacity. The sleeves have a frontal hoop section having an opening for holding articles and/or containers therefor. End caps having similar tabs and slots for assembly with the sleeve assembly are provided for enabling fastener attachment to a mounting surface. The rack may be mounted horizontal in a desired length for directly carrying or supporting articles to be stored or organized. The racks may be vertically mounted in spaced pairs for carrying elongated articles such as fishing rods, golf clubs, and garden tools. The present invention thus provides a rack system that can be readily assembled in variable lengths from modular components for desired storage and organizing capability.

DESCRIPTION OF DRAWINGS

The above and other features and advantages of the present invention will become apparent upon reading the following detailed description taken in conjunction with the accompanying drawings in which.

DETAILED DESCRIPTION OF THE PREFERRED EMBODIMENTS

Figure 1:
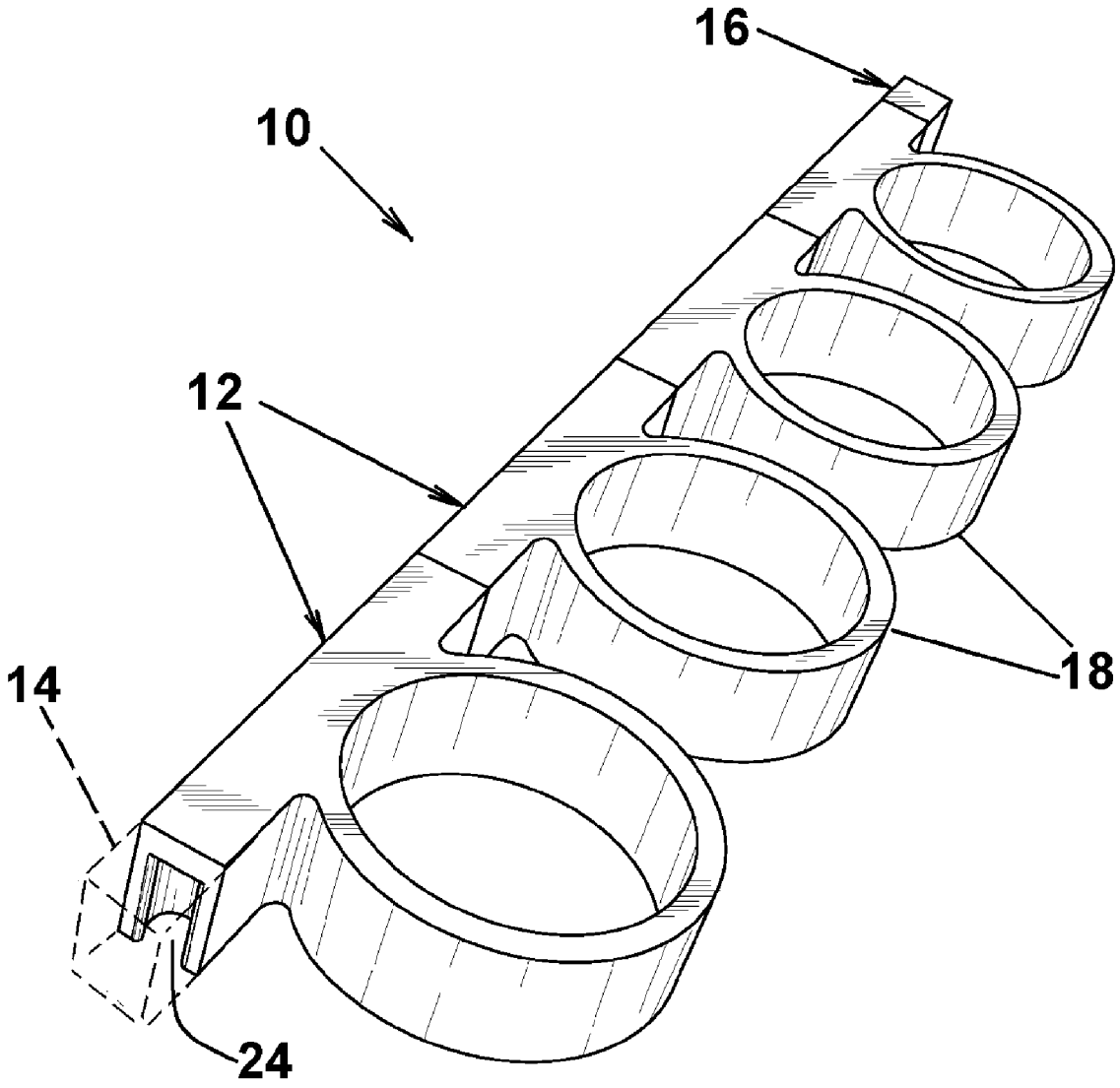
FIG. 1 is a perspective view of an assembled modular storage rack.
Figure 2:
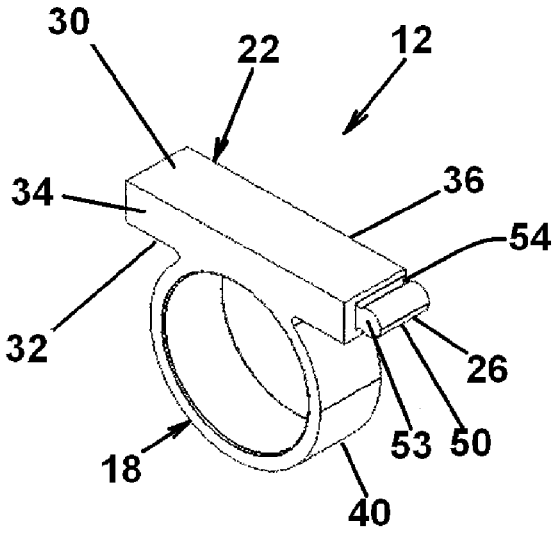
FIG. 2 is a perspective view of a modular support sleeve for the storage rack.
Figure 3:
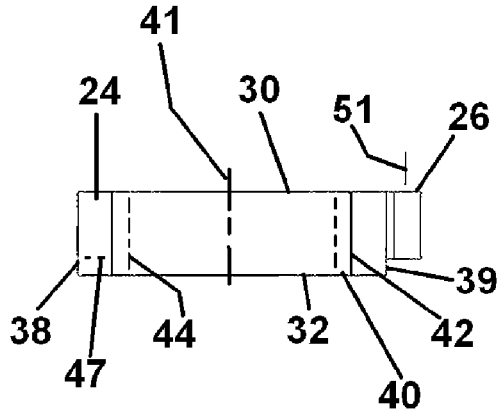
FIG. 3 is a top view of the support sleeve.
Figure 4:
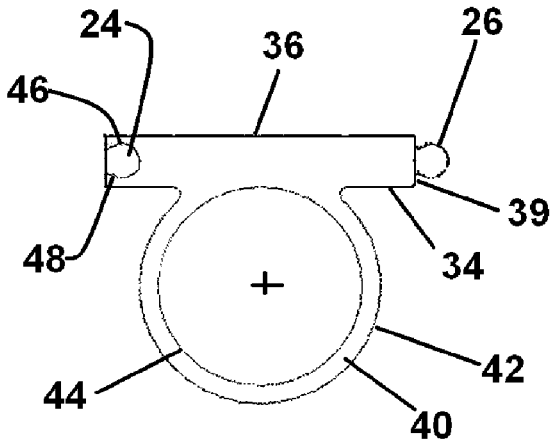
FIG. 4 is an end view of the support sleeve.
Figure 5:
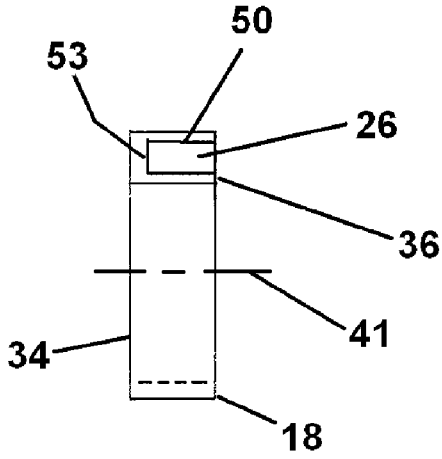
FIG. 5 is a side view of the support sleeve.
Figure 7:
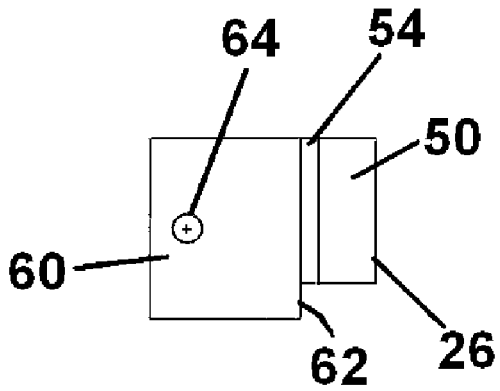
FIG. 7 is a top view of the left end cap.
Figure 6:
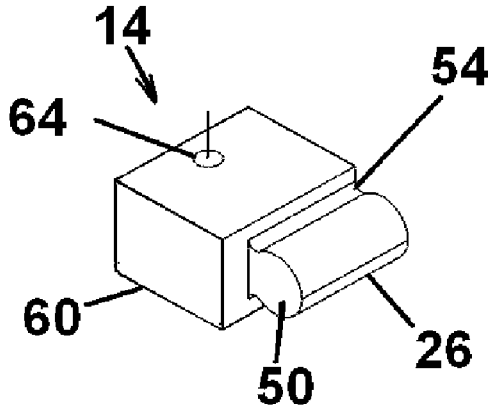
FIG. 6 is a perspective view of the left end cap of the rack.
Figure 8:
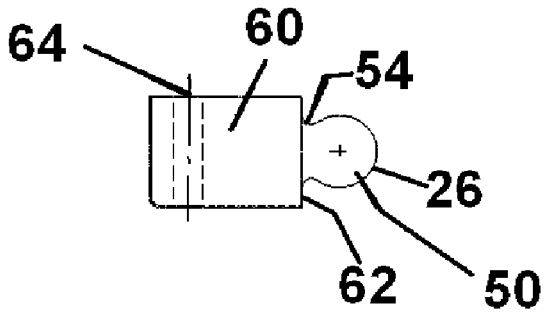
FIG. 8 is an end view of the left end cap.
Figure 9:
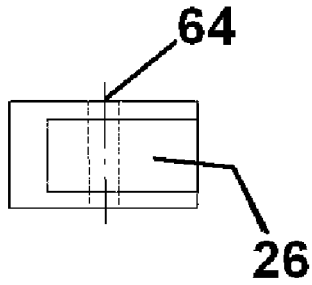
FIG. 9 is a side view of the left end cap.
Figure 11:
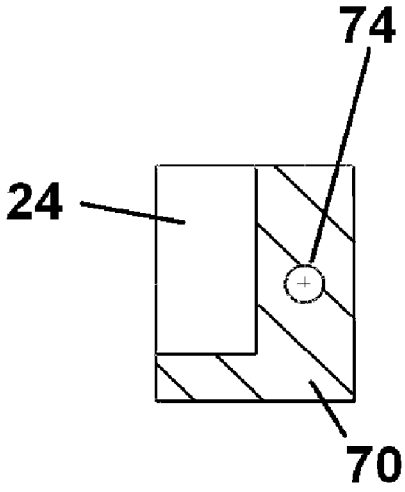
FIG. 11 is a top view of the right end cap.
Figure 10:
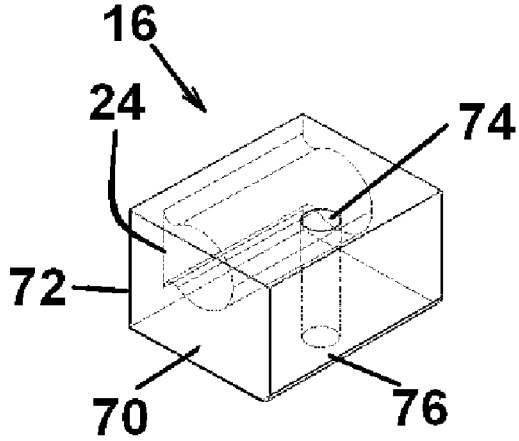
FIG. 10 is a perspective view of the right end cap of the rack.
Figure 12:
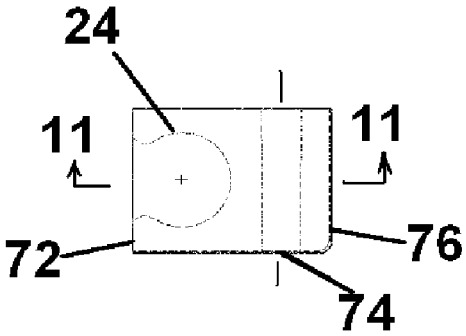
FIG. 12 is an end view of the right end cap.
Figure 13:
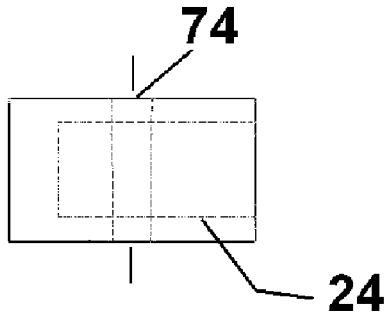
FIG. 13 is a side view of the right end cap.

Referring to the FIG. 1, there if shown a modular support rack 10 comprising a plurality of aligned and releasably interlocked support sleeves 12 that are releasably interlocked at the ends by a left end cap 14 and a right end cap 16. Each of the support sleeves includes a forwardly projecting hoop section 18 for carrying articles for the purposes of supporting, organizing and like activities as described in greater detail below. As will become hereinafter apparent, varying numbers of support sleeves 12 may be interlocked and connected with the end caps 14, 16 to form assemblies for selected purposes, and mounted in selected orientation, alone or with other like assemblies.

Referring to FIGS. 2 through 5, the support sleeve 12 comprises a unitary body formed of a suitable plastic material such as ABS plastic for strength and environmental properties. The sleeve 12 includes a longitudinal base 22 having the hoop section 18 integrally formed transversely at the front thereof. The base 22 includes a rearwardly and outwardly opening, vertically extending assembly slot 24 at the left end thereof, and an outwardly projecting, vertically extending tab 26 at the right end thereof. The base 22 has a generally rectangular cross section having a top wall 30, a bottom wall 32, a front wall 34, a rear wall 36 and end walls 38 and 39.

The hoop section 18 has a cylindrical body 40 having an axis 41 parallel to the front wall 34. The body 40 includes an outer semi-cylindrical outer wall 42 and a coaxial cylindrical inner wall 44. The inner ends of the outer wall 42 blend at a radius with the front wall 34. The top surface of the body 40 is coplanar with the top wall 30. The bottom surface of the body is coplanar with the bottom wall 32.

The slots 24 and tabs 26 are common to the support sleeves and the end caps. With reference to such structure on the support sleeve, the frontal surfaces of the slot 24 and the tab 26 are recessed behind the front wall 34 and below the top wall 42 whereby in assembly the front wall bears a segmented continuous appearance adding to the aesthetic appeal of the support rack. The slot 24 is recessed inwardly of the end wall 38 and is defined by a circular semi-cylindrical inner wall 46 having an axis parallel to the rear wall 36 and a base wall 47 normal to the rear wall 36, and laterally spaced side entrance walls 48 connecting the end wall 38 with the ends of the inner side wall 46 and narrower in width than the inner wall 46. The side wall spans an included angle of greater than 180°, preferably about 240° to 300° to establish a longitudinal interlocking engagement with a complementary tab of an adjacent component.

The tab 26 has a complementary configuration establishing a telescopic sliding, light compressive fit in assembly with an adjacent slot. The tab 26 includes a circular semi-cylindrical body 50 having an axis parallel to the rear wall 36. The tab 26 has a length substantially the same as the depth of the slot 24. The body 50 is connected with the end wall 39 by a base section 54 having a sliding fit with the side walls 48 of the slot. The axes of the body and the inner wall of the slot are spaced a comparable distance from the adjacent end walls whereby in assembly the adjacent end walls are proximate and coact to limit longitudinal bending of the assembly and interlock to establish longitudinal rigidity.

Referring to FIGS. 6 through 9, the left end cap 14 includes a rectangular body 60 of cross section similar to the sleeve body thereby forming a longitudinal continuation thereof. The body 60 includes a tab 26 as described above extending inwardly from an inner wall 62 for telescopic assembly with an adjacent slot 24 of a support sleeve. A through hole 64 is formed in the body 60 adjacent the outer end wall extending between the front and rear walls thereof for receiving a fastener for mounting the support rack on a support surface. Referring to FIGS. 10 through 13, the right end cap 16 includes a rectangular body 70 of cross section similar to the sleeve body. The body 70 includes a rearwardly opening slot 24 as described above extending inwardly from an inner end wall 72 for telescopic assembly with an adjacent tab 26 of a support sleeve. A through hole 74 is formed in the body adjacent the outer end wall 76 extending between the front and rear walls thereof for receiving a fastener for mounting the support rack on a support surface.

Figure 14:
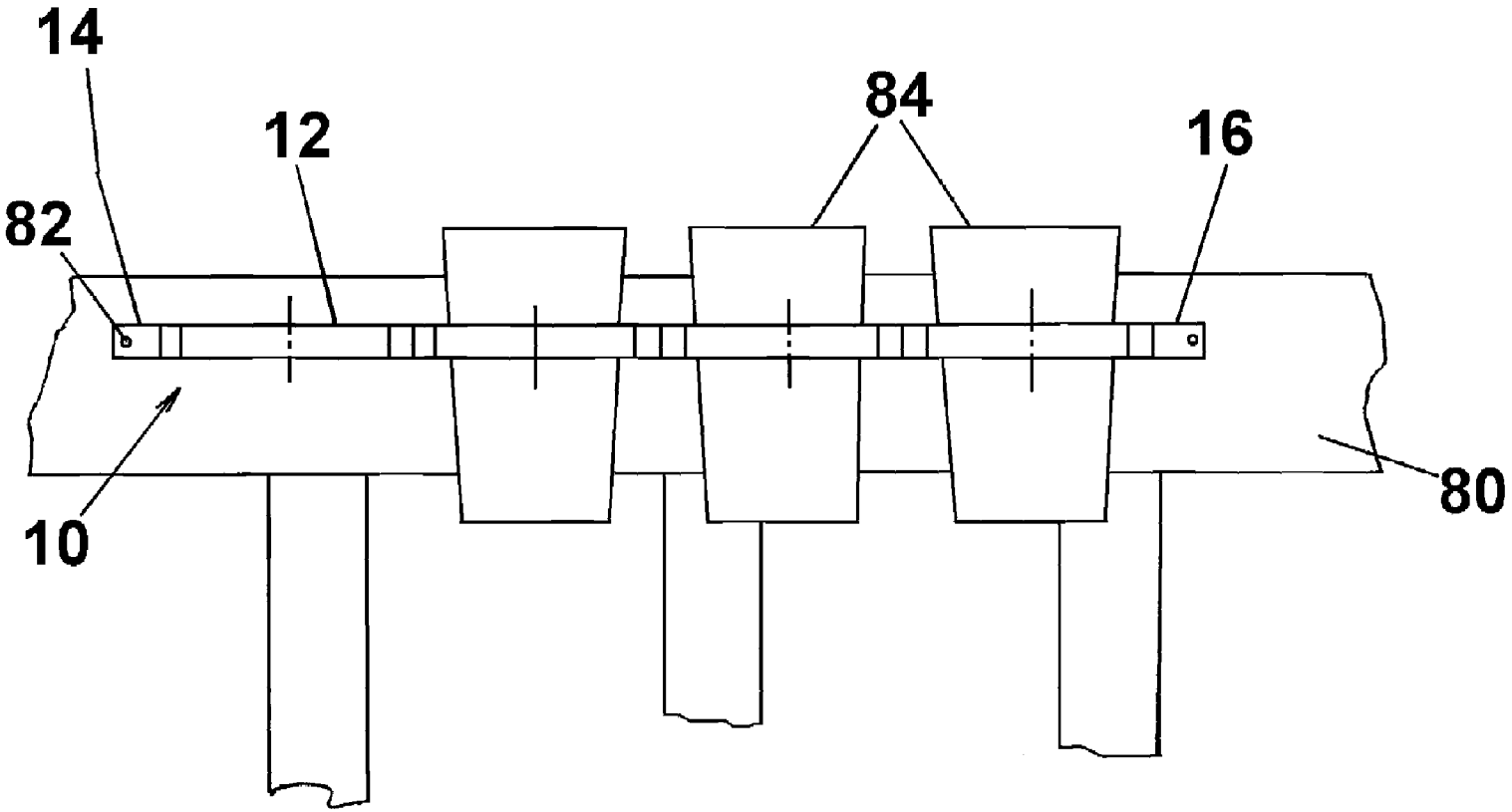
FIG. 14 if a front view of the modular support rack horizontally mounted on a frame and carrying containers on the support sleeves.
Figure 15:
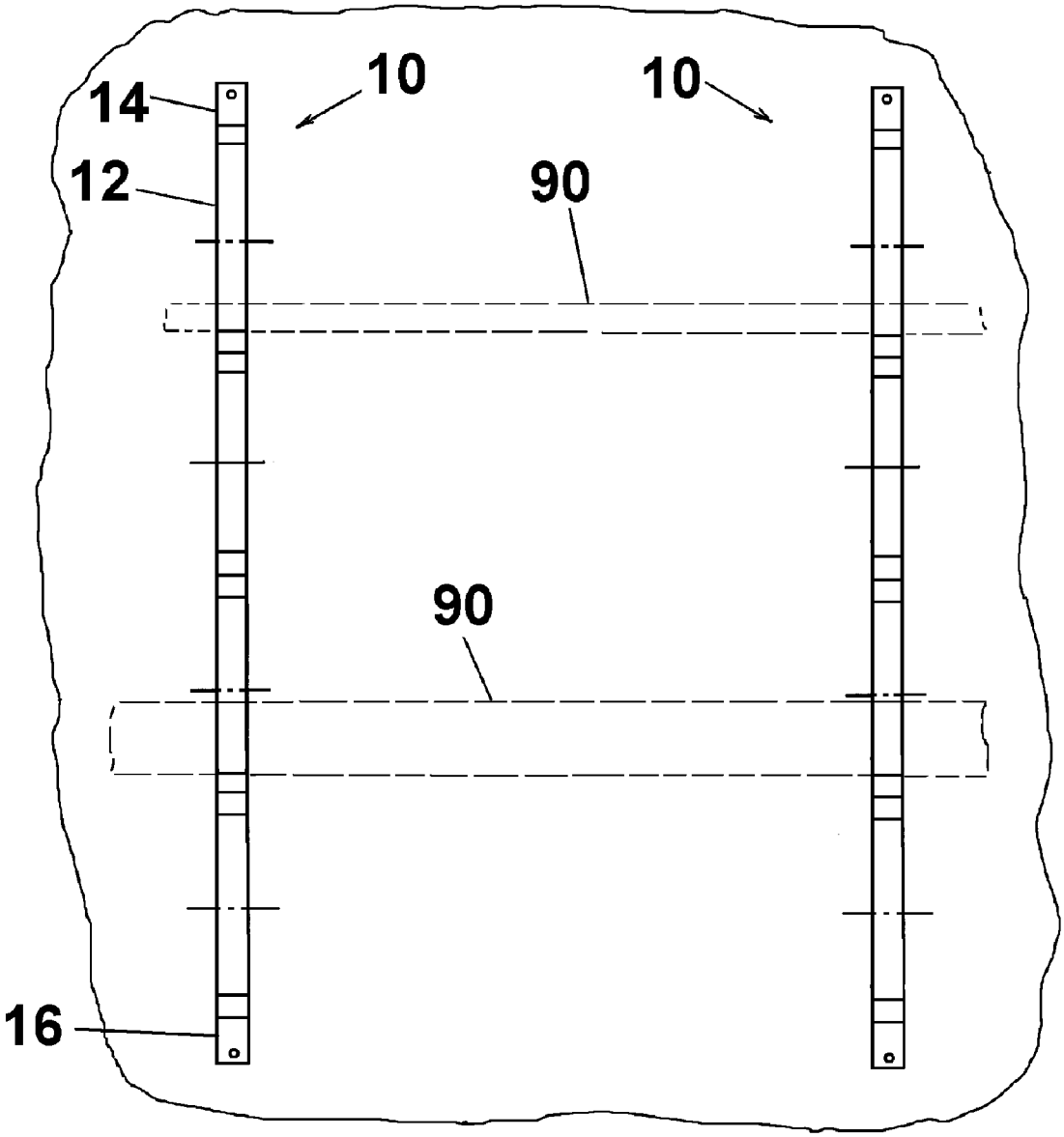
FIG. 15 is a front view of a pair of modular support rack vertically mounted on a support surface and carrying elongated articles.
Figure 16:
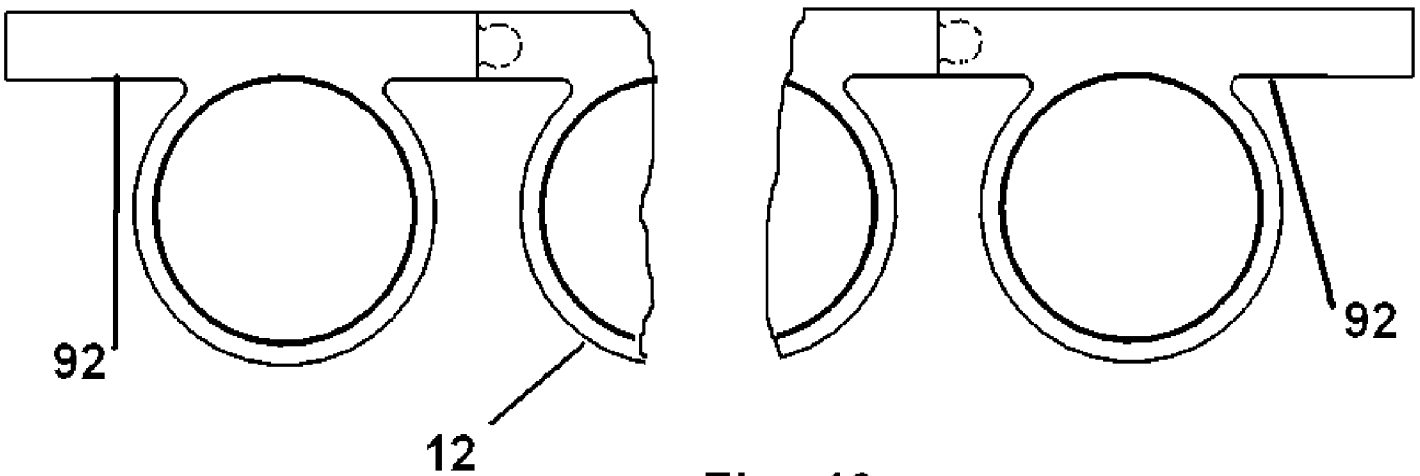
FIG. 16 is a top view of an assembled storage rack in accordance with another embodiment of the invention.
Figure 17:
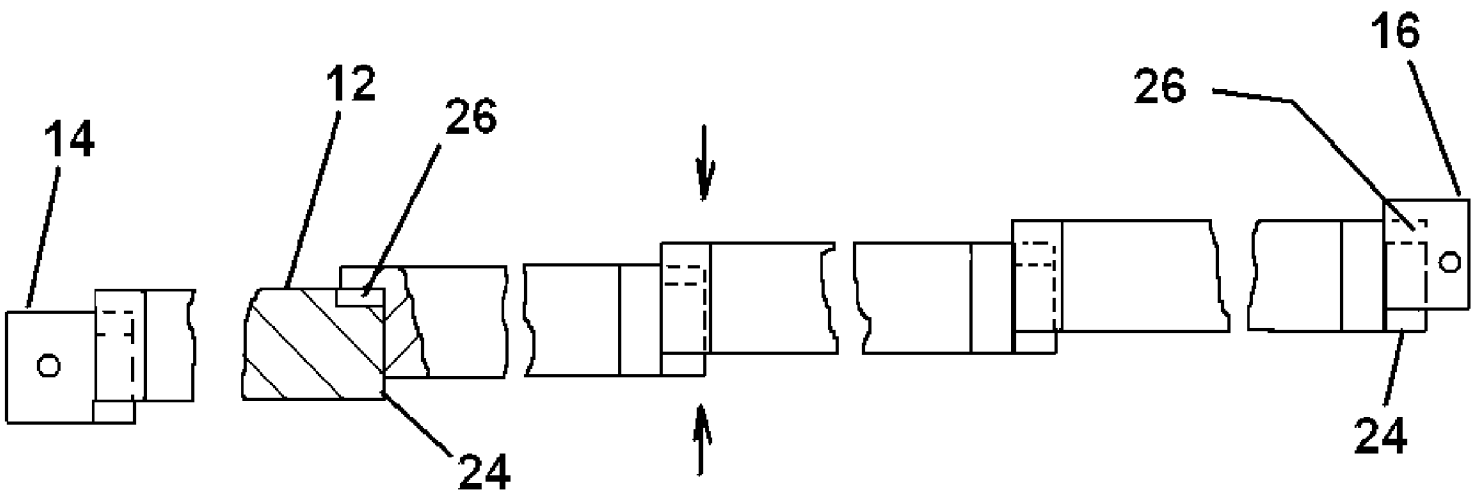
FIG. 17 is a front view of the storage rack in progressive assembly.

For assembly as shown in FIG. 17, the desired number of sleeves for an intended application is selected, and the tabs 24 are aligned with adjacent slots and inserted therein until fully seated. In a similar fashion, the tab of the end cap 14 is aligned with and assembled to the adjacent sleeve slot, and the slot of the other end cap 16 aligned the adjacent sleeve tab and assembled. The assembled support rack may be deployed for a wide variety of organization and storage functions. In a representative horizontal mode as shown in FIG. 14, the support rack 10 is mounted at the end caps 14, 16 on the top rail 80 of an outdoor deck by threaded fasteners 82. The sleeves 12 may hold containers 84 for beverages or utensils. In an office or workroom setting, the rack and containers may hold supplies, tools, parts and like small items in organized fashion. Moreover, the rack may be used for forming and displaying baseball type hats as disclosed in my prior referenced patent. The rack may also be used for vertically orienting items, such as in a garage for lawn tools. As shown in FIG. 15, the rack may be mounted vertically, singularly or in multiples, for supporting between the sleeves elongated articles, such as fishing gear, golf clubs, umbrellas and the like. The rack may also be suspended from a ceiling mounting surface for overhead storage and organizing of such item. Referring to FIG. 16, there is illustrated a rack 90 according to another embodiment wherein the end caps are integral with respective end sleeves 92. This modification may be adapted for assemblies of three sleeves or greater.

The rack may be made in a variety of sizes based on the needs and strength consideration of an end application. A size particularly suited for the above describe applications uses 5 inch long sleeve sections with a 3 inch diameter opening. Pin and slot diameters of about ¼ inch provide positive and non-deflecting interlocking.

It will be appreciated that interlocking connections and support sleeves may take alternative shapes for the interlocking and carrying functions. Thus outwardly diverging slot/tab interfaces of non-circular configurations may be employed. Also, non-circular sleeve openings may be used for rectangular or irregularly formed containers or articles. For instance, in a baseball hat application a D-shaped cross section provides a compact sleeve for forming and holding the hat brim. For more defined shaping, oval or other cross sectional shaped may be used. Further, rather than having separate end caps, the structure and function can be integrated on the outermost sleeves.

The above description is intended to be illustrative of the preferred embodiment, and modifications and improvements thereto will become apparent to those in the art. Accordingly, the scope of the invention should be construed solely in accordance with the appended claims.

What is claimed is:

1. A support rack for storing and organizing articles on a mounting surface, comprising: an assembly of at least one support sleeve member and first and second end members, said members having rear walls for engaging the mounting surface and front walls laterally spaced from said rear walls and top and bottom walls transverse to said rear walls; a tab member formed at one end of said sleeve member and said first end member and extending longitudinally outward therefrom, each tab member having a cylindrical wall and a connecting section; a slot formed in the other end of said sleeve member and said second end member defined by a cylindrical surface having a sliding telescopic fit in assembly with said tab member and connecting section of said first end member; a hoop section on said support sleeve member extending forwardly from said front wall, said hoop section including an aperture therein for receiving the articles; and aperture means in said end members for receiving fasteners for mounting said assembly on the vertical surface and wherein said tab members are recessed below said top walls and said slots have base surfaces recessed below said top walls whereby in said assembly said tab members and said slots are not frontally visible.

2. The support rack as recited in claim 1 wherein said tab members and said slots have circular cylindrical surfaces.

3. The support rack as recited in claim 2 wherein said cylindrical surfaces have axes parallel to said rear wall.

4. The support rack as recited in claim 1 wherein the end surfaces of said sleeve member and said end members abut in assembly to prevent flexing.

5. The support rack as recited in claim 1 wherein said cylindrical surfaces of said tab members and said slots span an angle greater than 180°.

6. The support rack as recited in claim 5 wherein said slots span an angle of between 240° and 300°.

7. The support rack as recited in claim 1 wherein said end members and said sleeve members are formed of molded high strength plastic material.

8. The support rack as recited in claim 1 wherein said aperture in said hoop section is defined by an inner circular cylindrical wall.

9. The support rack as recited in claim 1 wherein said assembly includes a plurality of interconnected sleeve members including end sleeve members.

10. The support rack as recited in claim 9 wherein said end members are formed integrally with said end sleeve members.

* * * * *